US009947165B2

(12) United States Patent
Zhao et al.

(10) Patent No.: US 9,947,165 B2
(45) Date of Patent: Apr. 17, 2018

(54) LINKAGE DEVICE

(71) Applicant: GRG BANKING EQUIPMENT CO., LTD., Guangzhou, Guangdong (CN)

(72) Inventors: Sheng Zhao, Guangdong (CN); Meng Guo, Guangdong (CN); Zhuang Jiang, Guangdong (CN); Dong Tan, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/316,198

(22) PCT Filed: Jul. 9, 2015

(86) PCT No.: PCT/CN2015/083646
§ 371 (c)(1),
(2) Date: Dec. 5, 2016

(87) PCT Pub. No.: WO2016/011896
PCT Pub. Date: Jan. 28, 2016

(65) Prior Publication Data

US 2017/0193730 A1 Jul. 6, 2017

(30) Foreign Application Priority Data

Jul. 23, 2014 (CN) ..... 2014 1 0353372

(51) Int. Cl.
*G07D 11/00* (2006.01)
*G07F 19/00* (2006.01)

(52) U.S. Cl.
CPC ..... *G07D 11/0021* (2013.01); *G07D 11/0084* (2013.01); *G07F 19/205* (2013.01)

(58) Field of Classification Search
CPC .. G07D 11/0021; G07D 11/0084; G07D 7/00; G07F 19/205

(Continued)

(56) References Cited

U.S. PATENT DOCUMENTS 4,844,446 A * 7/1989 Thie ..... G07D 11/0084 271/181
5,126,002 A * 6/1992 Iwata ..... B65B 27/08 156/468

(Continued)

FOREIGN PATENT DOCUMENTS

CN 102436691 A 5/2012
CN 103130014 A 6/2013

(Continued)

OTHER PUBLICATIONS

International Search Report for PCT/CN2015/083646, dated Sep. 18, 2015, ISA/CN.

(Continued)

*Primary Examiner* — Claude J Brown
(74) *Attorney, Agent, or Firm* — U.S. Fairsky LLP; Yue Xu

(57) ABSTRACT

A linkage device is provided, which includes: a banknote stacking plate, a cover plate, a transmission mechanism, and a driving mechanism. The first transmission component is mounted on the banknote stacking plate, and configured to drive the banknote stacking plate to rotate. The second transmission component and a spring are mounted on the cover plate, and the second transmission component is configured to drive the cover plate to rotate. The torque limiter is mounted on the first transmission component. The one-way bearing is mounted on the second transmission component. The linkage device may prevent a customer from placing banknotes into a fault position when depositing the banknotes, and may also avoid problems of the internal structures such as the banknote separating mechanism, the impeller wheel type banknote stacking mechanism exposed being blocked by foreign matters disposed, or being damaged for other reasons.

10 Claims, 10 Drawing Sheets

(58) Field of Classification Search
USPC ..... 235/379
See application file for complete search history.

(56) References Cited

U.S. PATENT DOCUMENTS

| | | | | |
|---|---|---|---|---|
| 6,254,083 | B1 | 7/2001 | Abe et al. | |
| 6,276,678 | B1 | 8/2001 | Nottelmann et al. | |
| 7,793,827 | B1 | 9/2010 | Lute et al. | |
| 8,485,432 | B2 * | 7/2013 | Holland-Letz | B65H 1/025 235/375 |
| 9,114,952 | B2 * | 8/2015 | Holland-Letz | B65B 5/108 |
| 2002/0148894 | A1 * | 10/2002 | Gerlier | G07D 11/0021 235/381 |
| 2008/0156614 | A1 | 7/2008 | Park et al. | |
| 2010/0052237 | A1 * | 3/2010 | Herczeg | B65H 7/00 271/3.16 |
| 2014/0131163 | A1 * | 5/2014 | Yun | G07F 19/202 194/206 |

FOREIGN PATENT DOCUMENTS

| | | | |
|---|---|---|---|
| CN | 203232491 | U | 10/2013 |
| CN | 203260107 | U | 10/2013 |
| CN | 103400442 | A | 11/2013 |
| CN | 103413376 | A | 11/2013 |
| CN | 203276392 | U | 11/2013 |
| CN | 104077838 | A | 10/2014 |
| DE | 19148864 | A1 | 5/1999 |
| EP | 3032504 | A1 | 6/2016 |
| JP | H10203680 | A | 8/1998 |
| WO | 2012123601 | A1 | 9/2012 |
| WO | 2014103531 | A1 | 7/2014 |

OTHER PUBLICATIONS

Extended European Search Report for corresponding Application No. 15824266.9; dated Sep. 27, 2017.

* cited by examiner

LINKAGE DEVICE

This application is the national phase of International Application No. PCT/CN2015/083646, titled "LINKAGE DEVICE", filed on Jul. 9, 2015 which claims the benefit of priority to Chinese patent application No. 201410353372.2, titled "LINKING DEVICE", filed with the Chinese State Intellectual Property Office on Jul. 23, 2014, the entire disclosures of which applications are incorporated herein by reference.

FIELD

The present application relates to the field of machinery, and particularly relates to a linkage device.

BACKGROUND

In conventional devices for processing paper currencies, especially an automatic teller machine (abbreviated as ATM), a device at a banknote dealing port having a banknote input function and a banknote output function is required to be equipped for achieving the function of paper currency exchanging between users and the devices.

Currently, a device at the banknote dealing port, which stacks banknotes by an impeller wheel, is adopted in the ATM, and separately designed banknote separating mechanism and impeller wheel type banknote stacking mechanism are adopted, thus there are two banknote dealing ports: a banknote deposit port and a banknote withdrawal port. If the banknote deposit port and the banknote withdrawal port are integrated into one opening (i.e., corresponding to one shutter position), it is necessary to use a banknote pressing plate to separate a banknote input area from a banknote output area at the banknote dealing port.

However, integrating the banknote dealing port corresponding to the banknote separating mechanism and the banknote dealing port corresponding to the banknote stacking mechanism into one opening is apt to cause problems that the banknote separating mechanism and the impeller wheel type banknote stacking mechanism are exposed outside when not needed, and therefore are possibly blocked by foreign matters disposed in the opening, a customer is apt to incorrectly place the banknotes to a fault position when depositing banknotes, and the impeller wheel, the banknote separating wheel and other structures inside the banknote dealing port are apt to be damaged due to being exposed outside. Therefore, a device which allows the banknote separating mechanism and the impeller wheel type banknote stacking mechanism to be integrated to work normally without causing exposure of the internal structures is urgently required.

SUMMARY

A linkage device is provided according to the present application, which can avoid causing problems such as blockage caused by foreign matters and damage of internal structures due to being exposed outside, and can improve safety of the internal structures of an ATM and allow the ATM to be friendly to use.

The linkage device according to the present application includes: a banknote stacking plate, a cover plate, a transmission mechanism, and a driving mechanism.

A first transmission component is mounted on the banknote stacking plate, and configured to drive the banknote stacking plate to rotate.

A second transmission component and a spring are mounted on the cover plate, and the second transmission component is configured to drive the cover plate to rotate.

A torque limiter is mounted on the first transmission component.

A one-way bearing is mounted on the second transmission component.

The transmission mechanism is mounted between the first transmission component and the second transmission component, and is configured to provide a medium for a transmission between the first transmission component and the second transmission component.

The driving mechanism is configured to provide a rotation power to the first transmission component.

After the banknote stacking plate rotates by a certain angle to cover a banknote separating mechanism under the action of a rotation power provided by the driving mechanism, the banknote stacking plate is maintained under the protection of the torque limiter, and the cover plate continues to rotate by a certain angle to cover an impeller wheel type banknote stacking mechanism under the action of a transmission force provided by the transmission mechanism; and after the banknote stacking plate reversely rotates by a certain angle to uncover the banknote separating mechanism under the action of a reverse rotation power provided by the driving mechanism, the banknote stacking plate is maintained under the protection of the torque limiter, and the one-way bearing releases the action on a shaft due to the reverse rotation of the transmission mechanism, and the cover plate reversely rotates by a certain angle to uncover the impeller wheel type banknote stacking mechanism under the action of the spring.

Optionally, the first transmission component is a banknote stacking plate gear, and the second transmission component is a cover plate gear.

Optionally, the driving mechanism includes a motor and an output gear; the motor is configured to provide power; and the output gear fit the banknote stacking plate gear by engaging and is configured to transmit the power outputted by the motor to the banknote stacking plate gear.

Optionally, the transmission mechanism includes N gears, with N being an even number; and the N gears fit each other by engaging.

Optionally, the output gear, the banknote stacking plate gear, the N gears and the cover plate gear fit by engaging in the listed sequence.

Optionally, the linkage device further includes a support frame; the support frame is configured to support the linkage device;

the support frame includes a first side plate and a second side plate, the banknote stacking plate is mounted between the first side plate and the second side plate, and the cover plate is mounted between the first side plate and the second side plate; and the driving mechanism, the first transmission component, the transmission mechanism and the second transmission component are each mounted on the second side plate.

Optionally, the support frame further includes a position-limiting structure; and the position-limiting structure is configured to limit a rotation angle of the banknote stacking plate when the banknote stacking plate rotates by a certain angle to cover the banknote separating mechanism under the action of the rotation power provided by the driving mechanism.

Optionally, the linkage device further includes: a foil detector, which is mounted on the cover plate and configured to trigger a sensor, and the sensor, which is mounted on the support frame, used comparatively with the foil detector, and configured to send an electrical signal to the linkage device when the foil detector triggers the sensor.

Optionally, when the cover plate continues to rotate by a certain angle to cover the impeller wheel type banknote stacking mechanism under the action of the transmission force provided by the transmission mechanism, the foil detector triggers the sensor, and after the linkage device receives the electrical signal, the driving mechanism is maintained and does not rotate.

Optionally, the sensor is a U-shaped sensor, and one torsion spring is mounted on a cover plate shaft at one end of the cover plate.

As illustrated in the above technical solutions, the embodiments of the present application have the following advantages.

In the embodiments of the present application, the linkage device includes: the banknote stacking plate, the cover plate, the transmission mechanism, and the driving mechanism. The first transmission component is mounted on the banknote stacking plate, and configured to drive the banknote stacking plate to rotate. The second transmission component and a spring are mounted on the cover plate, and the second transmission component is configured to drive the cover plate to rotate. The torque limiter is mounted on the first transmission component. The one-way bearing is mounted on the second transmission component. The transmission mechanism is mounted between the first transmission component and the second transmission component, and is configured to provide the medium for the transmission between the first transmission component and the second transmission component. The driving mechanism is configured to provide the rotation power to the first transmission component. After the banknote stacking plate rotates by a certain angle to cover the banknote separating mechanism under the action of a rotation power provided by the driving mechanism, the banknote stacking plate is maintained under the protection of the torque limiter, and the cover plate continues to rotate by a certain angle to cover the impeller wheel type banknote stacking mechanism under the action of a transmission force provided by the transmission mechanism. After the banknote stacking plate reversely rotates by a certain angle to uncover the banknote separating mechanism under the action of a reverse rotation power provided by the driving mechanism, the banknote stacking plate is maintained under the protection of the torque limiter, and the one-way bearing releases the action on the shaft due to the reverse rotation of the transmission mechanism, and the cover plate reversely rotates by a certain angle to uncover the impeller wheel type banknote stacking mechanism under the action of the spring. In the embodiments of the present application, when it needs to place banknotes and the shutter is in an opened state, the banknote separating mechanism is already covered by the banknote stacking plate, and meanwhile the impeller wheel type banknote stacking mechanism is already covered by the cover plate. In this state, the banknote dealing port has only one area enclosed by the banknote stacking plate, the cover plate, a banknote pressing plate and the left side plate and the right side plate, which may prevent a customer from placing banknotes into a fault position when depositing the banknotes, and may also avoid issues of the internal structures such as the banknote separating mechanism, the impeller wheel type banknote stacking mechanism exposed being blocked by foreign matters disposed, or being damaged due to other reasons, thus improving safety of the internal structures of the ATM, and allowing the ATM to be friendly to use.

DETAILED DESCRIPTION

It is provided according to the present application a linkage device, configured to avoid causing issues, such as, blockage by foreign matters, damage of internal structures due to being exposed, to improve safety of the internal structures of an ATM, and also enable the ATM to be friendly to use.

For making the objects, features and advantages of the present application clearer and easier to be understood, the technical solutions according to the present application are described in detail hereinafter in conjunction with the drawings in the embodiments of the present application. Apparently, the embodiments described hereinafter are only a part of the embodiments of the present application, rather than all embodiments. Based on the embodiments in the present application, all of other embodiments, made by those skilled in the art without any creative efforts, fall into the scope of the present application.

Figure 1:
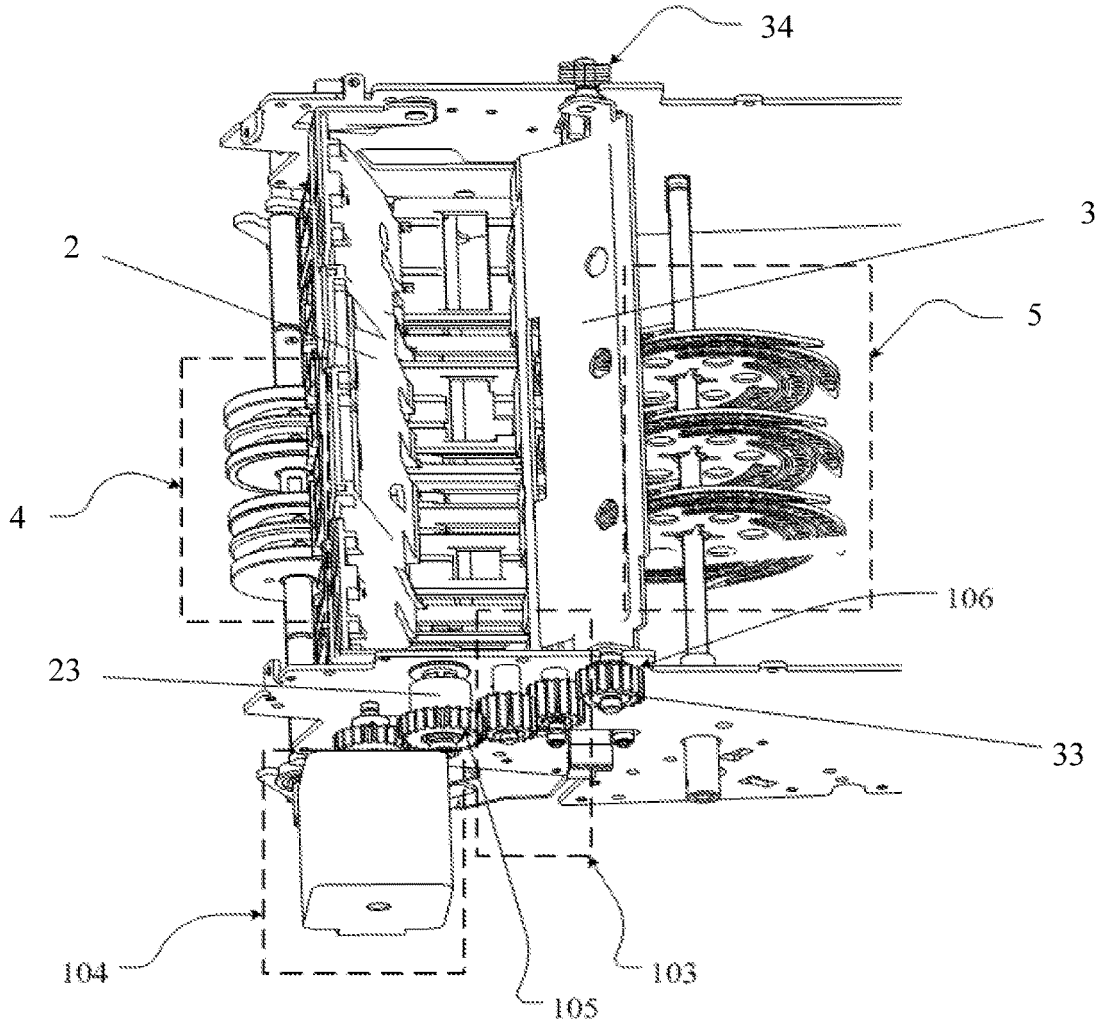
FIG. 1 is a schematic view showing the structure of a linkage device according to an embodiment of the present application.

Referring to FIG. 1, a linkage device according to an embodiment of the present application includes: a banknote stacking plate 101, a cover plate 102, a transmission mechanism 103 and a driving mechanism 104.

A first transmission component 105 is mounted on the banknote stacking plate 101, and is configured to drive the banknote stacking plate 101 to rotate.

A second transmission component 106 and a spring 107 are mounted on the cover plate 102, and the second transmission component 106 is configured to drive the cover plate 102 to rotate.

A torque limiter 108 is mounted on the first transmission component 105.

A one-way bearing 109 is mounted on the second transmission component 106.

The transmission mechanism 103 is mounted between the first transmission component 105 and the second transmission component 106, and is configured to provide a medium for the transmission between the first transmission component 105 and the second transmission component 106.

The driving mechanism 104 is configured to provide a rotation power to the first transmission component 105.

After the banknote stacking plate 101 rotates by a certain angle to cover a banknote separating mechanism 110 under the action of the rotation power provided by the driving mechanism 104, the banknote stacking plate 101 is maintained under the protection of the torque limiter 108, and the cover plate 102 continues to rotate by a certain angle to cover an impeller wheel type banknote stacking mechanism 111 under the action of a transmission force provided by the transmission mechanism 103.

The banknote stacking plate 101, after reversely rotating by a certain angle under the action of a reverse rotation power provided by the driving mechanism 104, opens the banknote separating mechanism 110, the banknote stacking plate 101 is maintained under the protection of the torque limiter, and the one-way bearing 109 releases an action to a shaft due to the reverse rotation of the transmission mechanism, and the cover plate 102 reversely rotates by a certain angle to uncover the impeller wheel type banknote stacking mechanism 111 under the action of the torsion spring 107.

In this embodiment, operating steps of the linkage device described before are as follows. The driving mechanism 104 provides a rotation power to the first transmission component 105, and the first transmission component 105 drives the banknote stacking plate 101 to rotate. After the banknote stacking plate 101 rotates by a certain angle to cover the banknote separating mechanism 110 under the action of the rotation power provided by the driving mechanism 104, the banknote stacking plate 101 is maintained under the protection of the torque limiter 108. The first transmission component 105 drives the second transmission component 106 via the transmission mechanism 103. Driven by the second transmission component 106, the cover plate 102 rotates by a certain angle to cover the impeller wheel type banknote stacking mechanism 111 under the action of the transmission force provided by the transmission mechanism 103. After the banknote stacking plate 101 rotates by a certain angle to open the banknote separating mechanism 110 under the action of the rotation power provided by the driving mechanism 104, the banknote stacking plate 101 is maintained under the protection of the torque limiter. The one-way bearing 109 releases the action to the shaft due to the reverse rotation of the transmission mechanism. The cover plate 102 reversely rotates by a certain angle to uncover the impeller wheel type banknote stacking mechanism 111 under the action of the torsion spring 107. In this embodiment, when banknotes are required to be placed and a shutter is in an opened state, the banknote separating mechanism 110 is already covered by the banknote stacking plate 101, and meanwhile the impeller wheel type banknote stacking mechanism is already covered by the cover plate 102. In this state, an banknote dealing port only has one area enclosed by the banknote stacking plate, the cover plate, a banknote pressing plate and a left side plate and a right side plate, which may prevent a customer from placing banknotes into a fault position when the banknotes are deposited, and may also avoid problems of the impeller wheel type banknote stacking mechanism and other internal structures exposed outside being blocked by foreign matters disposed in the banknote separating mechanism, or being damaged due to other reasons, thus improving safety of the internal structures of the ATM, and allowing the ATM to be friendly to use.

Figure 2:
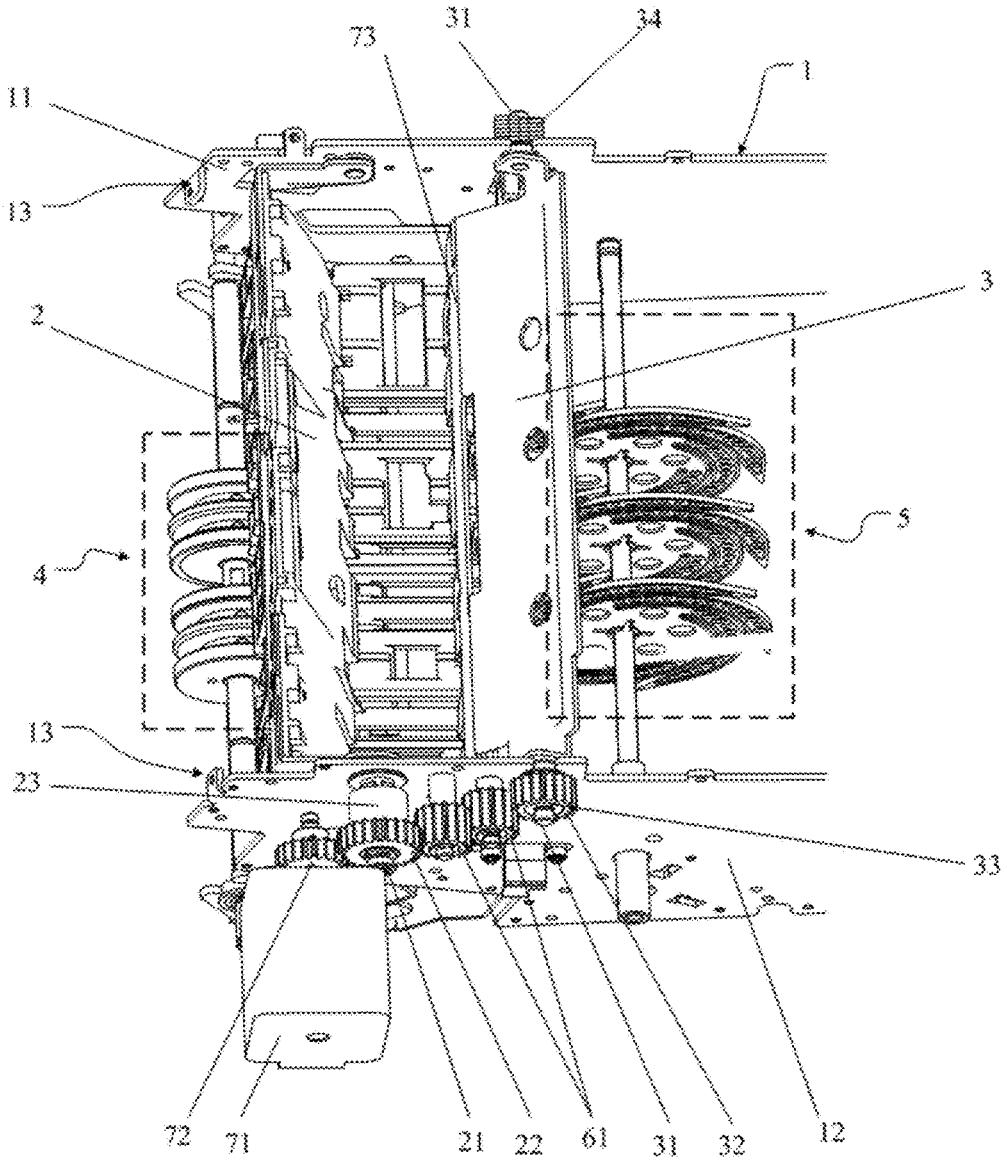
FIG. 2 is a view showing the structure the structure of a linkage device according to another embodiment of the present application.

For ease of understanding, the linkage device according to the present application is described in detail hereinafter. Referring to FIG. 2, a linkage device according to another embodiment of the present application includes: a support frame 1, a banknote stacking plate 2, a cover plate 3, a transmission mechanism, and a driving mechanism.

Figure 10:
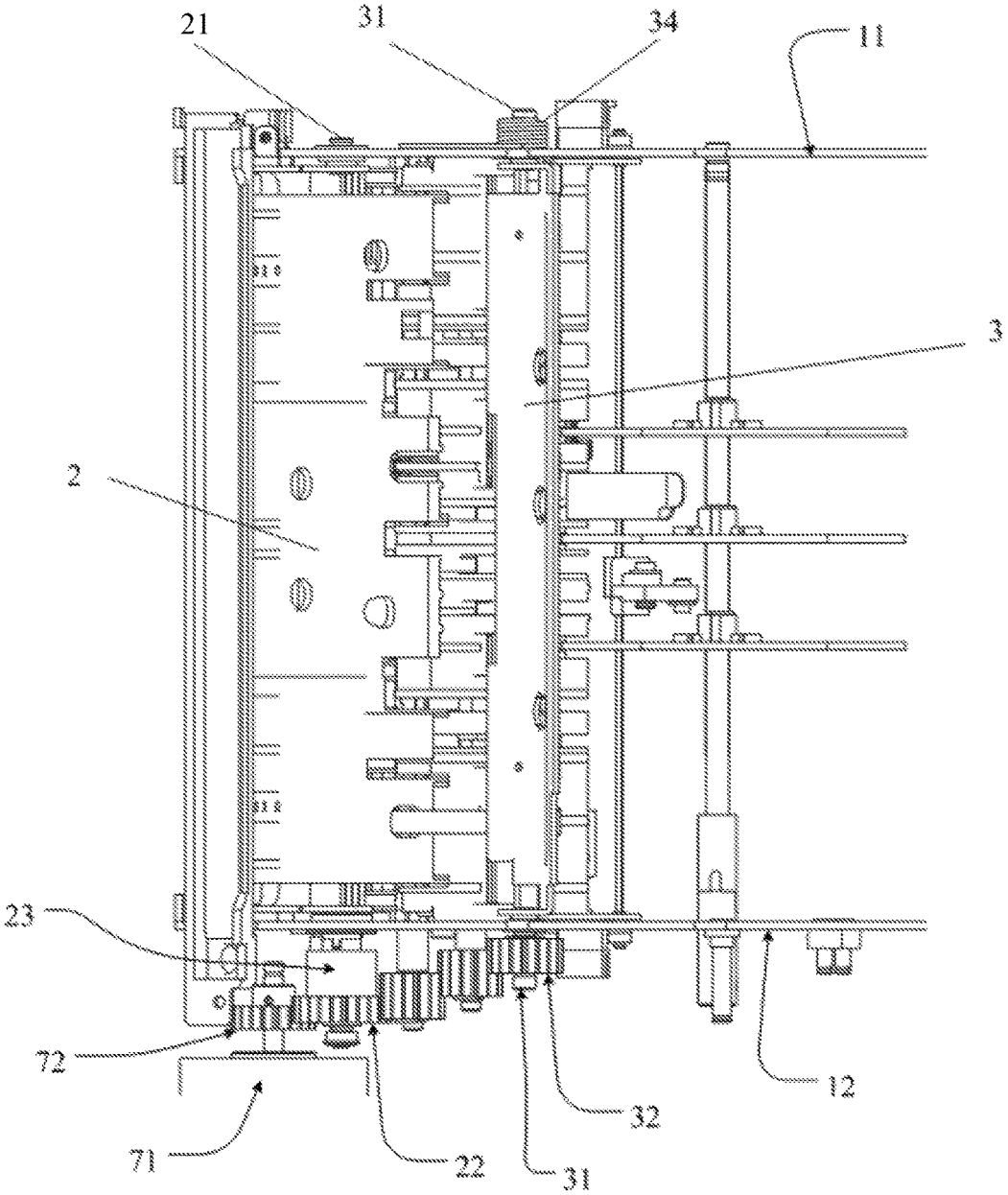
FIG. 10 is a bottom view of FIG. 2.

Referring to FIG. 2, the support frame 1 is configured to support the whole linkage device, and the support frame 1 includes a first side plate 11 and a second side plate 12. The banknote stacking plate 2 is mounted between the first side plate 11 and the second side plate 12, and the cover plate 3 is mounted between the first side plate 11 and the second side plate 12. The support frame 1 further includes a position-limiting structure 13, which is configured to limit a rotation angle of the banknote stacking plate 2 when the banknote stacking plate 2 rotates by a certain angle to cover a banknote separating mechanism 4 under the action of the rotation power provided by the driving mechanism. Each of the first side plate 11 and the second side plate 12 may be provided with the position-limiting structure 13. A sensor 14 may be further provided on the support frame 1, and the sensor 14 specifically may be mounted on an inner side of the first side plate 11, and may also be mounted on an inner side of the second side plate 12. FIG. 10 is a top view of FIG. 2.

Figure 4A:
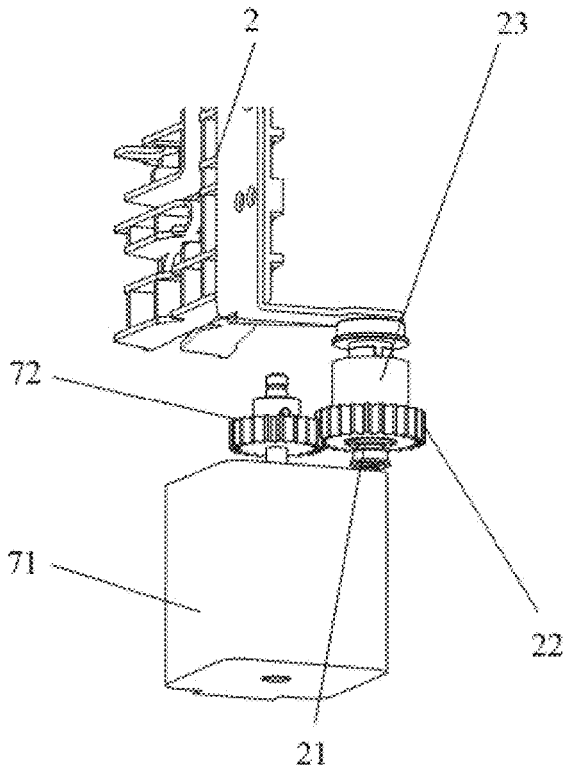
FIG. 4*a* is a schematic view showing the structures of an output gear and a banknote stacking plate gear.

Referring to FIGS. 2 and 4*a*, the banknote stacking plate 2 is provided with a fixed shaft 21, and a banknote stacking plate gear 22 is mounted on the fixed shaft 21. The banknote stacking plate 2 is movably mounted between the first side plate 11 and the second side plate 12 by the fixed shaft 21, and is rotatable about the fixed shaft 21. A torque limiter 23 is mounted on the banknote stacking plate gear 22. The banknote stacking plate gear 22 is engaged with an output gear 72. When the output gear 72 rotates clockwise, the banknote stacking plate gear 22 rotates counterclockwise; and when the output gear 72 rotates counterclockwise, the banknote stacking plate gear 22 rotates clockwise.

Figure 3:
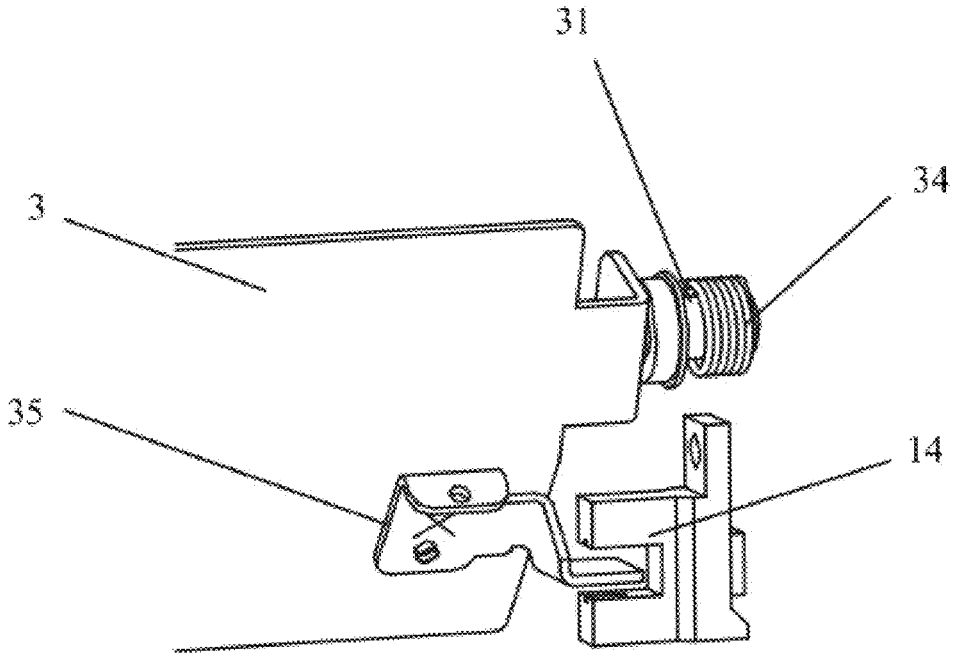
FIG. 3 is a schematic view showing partial structure of the linkage device according to the present application.
Figure 4B:
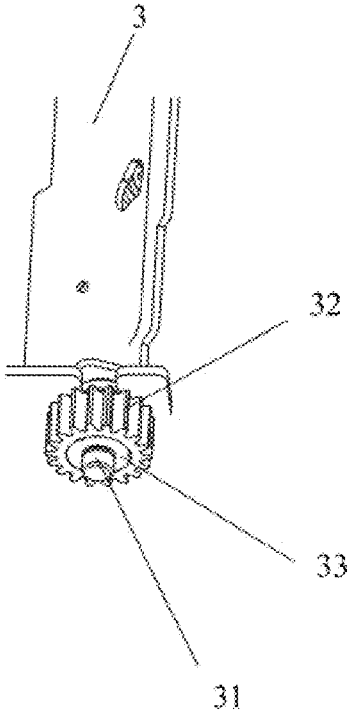
FIG. 4*b* is a schematic view showing the structure of a cover plate gear.

Referring to FIGS. 2, 3, and 4*b*, the cover plate 3 is provided with a cover plate shaft 31, and a cover plate gear 32 is mounted on the cover plate shaft 31. The cover plate 3 is movably mounted between the first side plate 11 and the second side plate 12 by the cover plate shaft 31, and is rotatable about the cover plate shaft 31. A one-way bearing 33 is provided on the cover plate gear 32 and is located between the cover plate shaft 31 and the cover plate gear 32. A spring 34 and a foil detector 35 are provided on the cover plate 1, and the foil detector 35 and the sensor 14 on the support frame 1 are used cooperatively. After the foil detector 35 triggers the sensor 14, the sensor 14 transmits an electrical signal to the linkage device.

Figure 5:
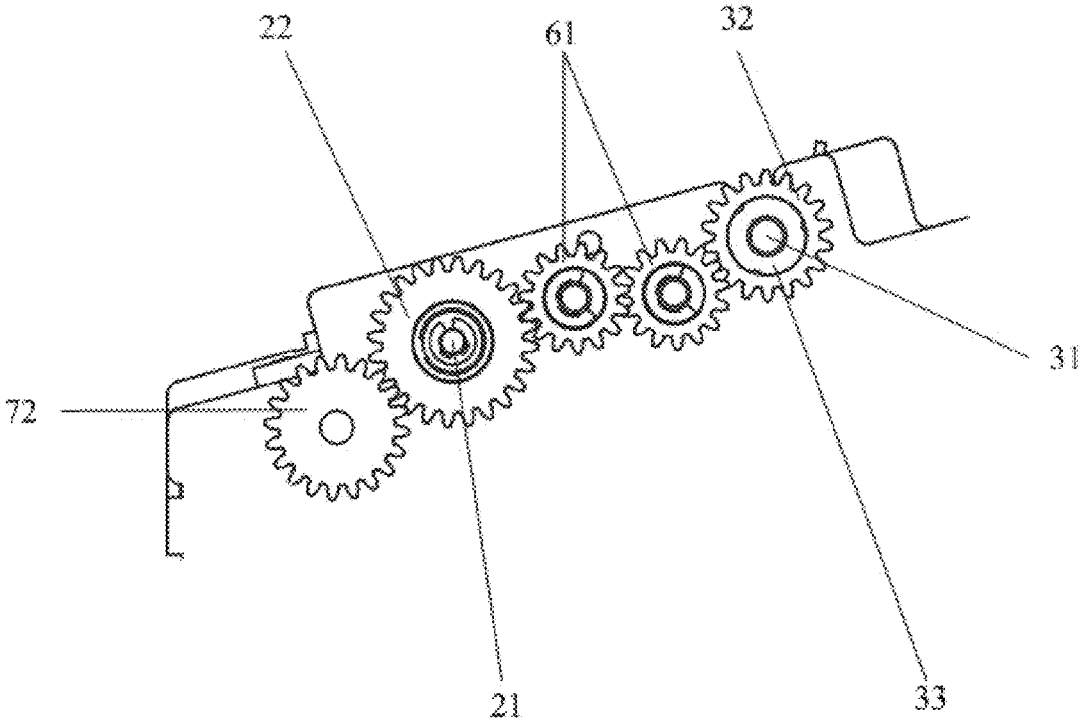
FIG. 5 is a schematic view showing the structure of the output gear, the banknote stacking plate gear, a transmission mechanism, and the cover plate gear which are fit by engaging.
Figure 6:
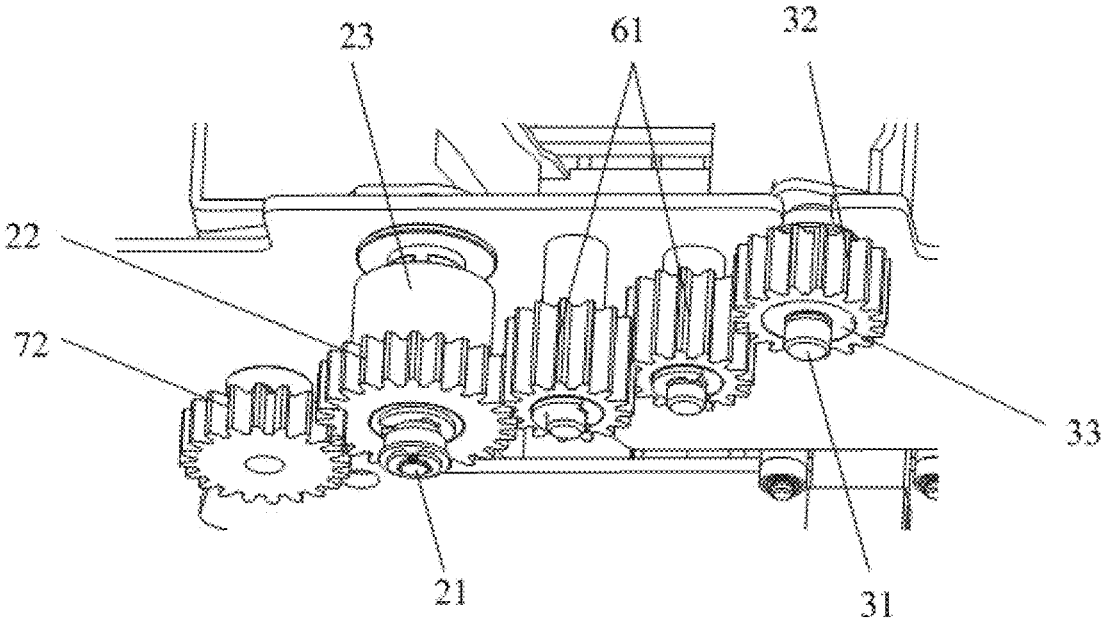
FIG. 6 is a perspective view of FIG. 5.

Referring to FIGS. 5 and 6, the transmission mechanism is mounted between the banknote stacking plate gear 22 and the cover plate gear 32, and is configured to provide a medium for transmission between the banknote stacking plate gear 22 and the cover plate gear 32. As illustrated in FIGS. 5 and 6, the output gear 72, the banknote stacking plate gear 22, N gears and the cover plate gear 32 fit each other by engaging in the listed sequence. The transmission mechanism may specifically include N gears 61, and N is an even number. These N gears 61 are fit by engaging in order. Through the transmission of the gears 61 of even number, the cover plate gear 32 may rotate counterclockwise when the banknote stacking plate gear 22 rotates clockwise, and may rotate clockwise when the banknote stacking plate gear 22 rotates counterclockwise. It should be noted that, the transmission mechanism may also be a transmission track.

Referring to FIG. 4*a*, the driving mechanism is configured to provide a rotation power to the banknote stacking plate gear 22. The driving mechanism specifically includes: a motor 71 and the output gear 72. The motor 71 is configured to provide power, and the output gear 72 fits the banknote stacking plate gear 22 by engaging, and is configured to transmit the power outputted by the motor 71 to the banknote stacking plate gear 22, to allow the banknote stacking plate gear 22 to rotate.

Figure 7:
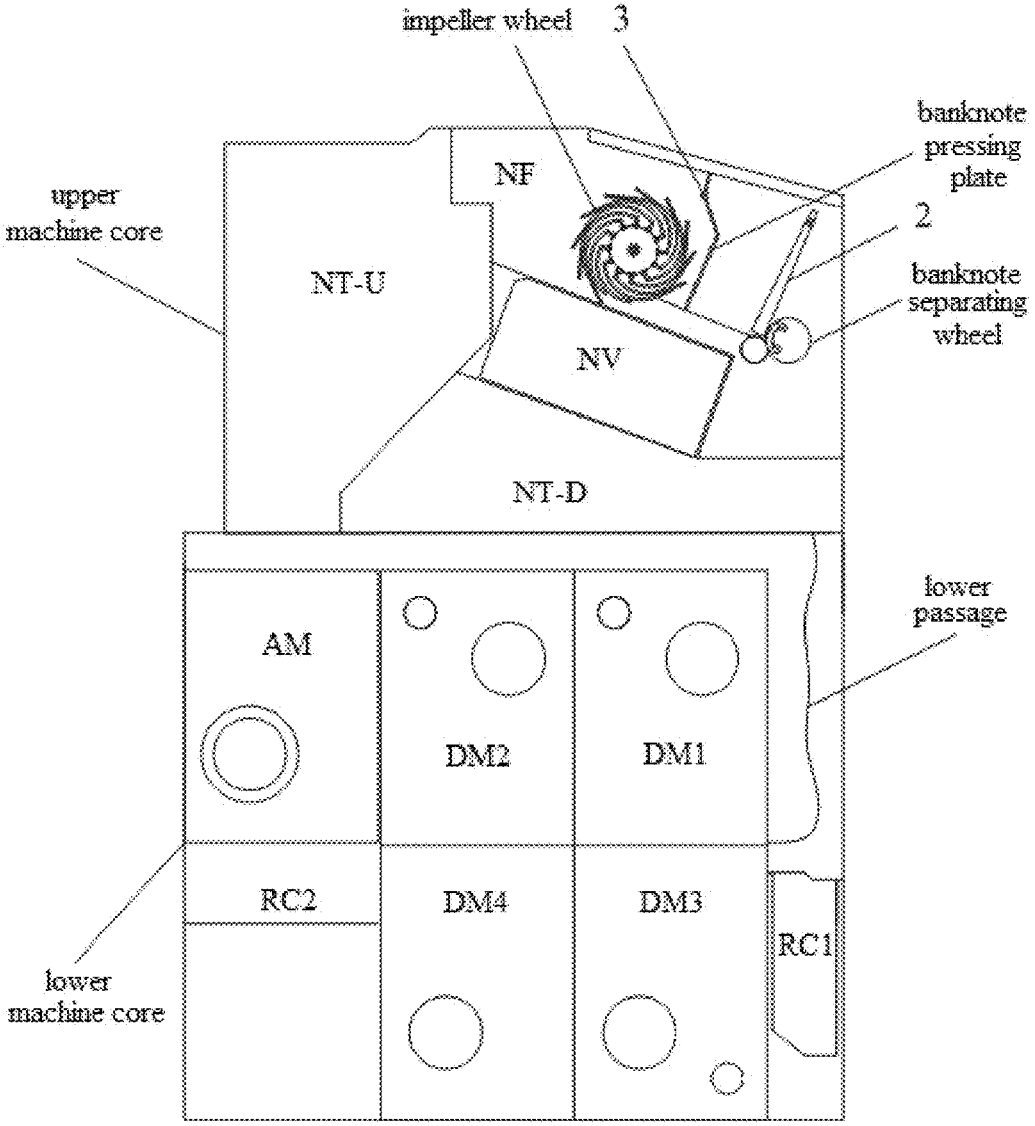
FIG. 7 is a view showing the overall structure of an ATM with the linkage device according to the present application being provided.

Reference is made to FIG. 7, which is a view showing the overall structure of an ATM where the linkage device is located. Positions of a shutter 8, the cover plate 3, the banknote stacking plate 2, the banknote separating mechanism 4 and an impeller wheel type banknote stacking mechanism 5 are shown in FIG. 7.

The driving mechanism, the banknote stacking plate gear 22, the transmission mechanism and the cover plate gear 32 may all be mounted on the second side plate 12.

When banknote is deposited and before the shutter at the banknote dealing port is opened, after the banknote stacking plate 2 rotates by a certain angle to cover the banknote separating mechanism 4 under the action of the rotation power provided by the driving mechanism, the banknote stacking plate 2 is maintained by protection of the torque limiter 23, and the cover plate 3 continues to rotate by a certain angle under the action of the transmission force continuously provided by the transmission mechanism, to cover, together with a banknote pressing plate 73, the impeller wheel type banknote stacking mechanism 5. It may be appreciated that, in this way, when the shutter at the banknote dealing port is opened, there may be only one area for placing banknotes, and the customer may not place the banknotes in a fault position, and the banknote separating mechanism and the impeller wheel type banknote stacking mechanism are both covered, and may also not be damaged.

After the banknotes are placed, the shutter at the banknote dealing port is closed, the banknote stacking plate 2 reversely rotates by a certain angle to uncover the banknote separating mechanism 4 under the action of the reverse rotation power provided by the driving mechanism. The banknote stacking plate 2 is maintained under the protection of the torque limiter 23, and the one-way bearing 33 releases the action on the cover plate shaft 31 due to the reverse rotation of the transmission mechanism, the cover plate 3 reversely rotates by a certain angle to uncover the impeller wheel type banknote stacking mechanism 5 (i.e., return to an upper side of the impeller wheel) under the action of the torsion spring 34. At this time, the banknote dealing port is divided into a banknote separating area and a banknote outputting area by the banknote pressing plate 73, and the banknote separating mechanism 4 may just start to separate the banknotes to deposit the banknotes into a cashbox, and meanwhile, the impeller wheel banknote stacking mechanism 5 may also return unqualified banknotes to the banknote outputting area at the banknote dealing port.

When the cover plate 3 continues to rotate by a certain angle to cover the impeller wheel type banknote stacking mechanism 5 under the action of the transmission force provided by the transmission mechanism, the foil detector 35 triggers the sensor 14. After the linkage device receives an electrical signal from the sensor 14, the driving mechanism is maintained and does not rotate. It is to be noted that the driving mechanism being maintained means a state in which the motor 71 does not rotate, and the output gear 72 is locked and cannot rotate.

Preferably, the spring 34 is a torsion spring, and one torsion spring is mounted on the cover plate shaft 31 at one end of the cover plate 3, which facilitates space saving.

Preferably, the sensor 14 is a U-shaped sensor. The U-shaped sensor facilitates the entering of foil detector 35 into the U-shaped sensor to trigger. Further, the U-shaped sensor has a small volume, thus is convenient to install.

Preferably, the spring 34 may be a torsion spring as shown in FIG. 3.

The state and process of working of the linkage device in the ATM is described in detail hereinafter, reference is made to FIGS. 2, 8 and 9.

The linkage device has two states respectively: a state of the shutter 8 being opened, and a state of the shutter 8 being closed.

Figure 8:
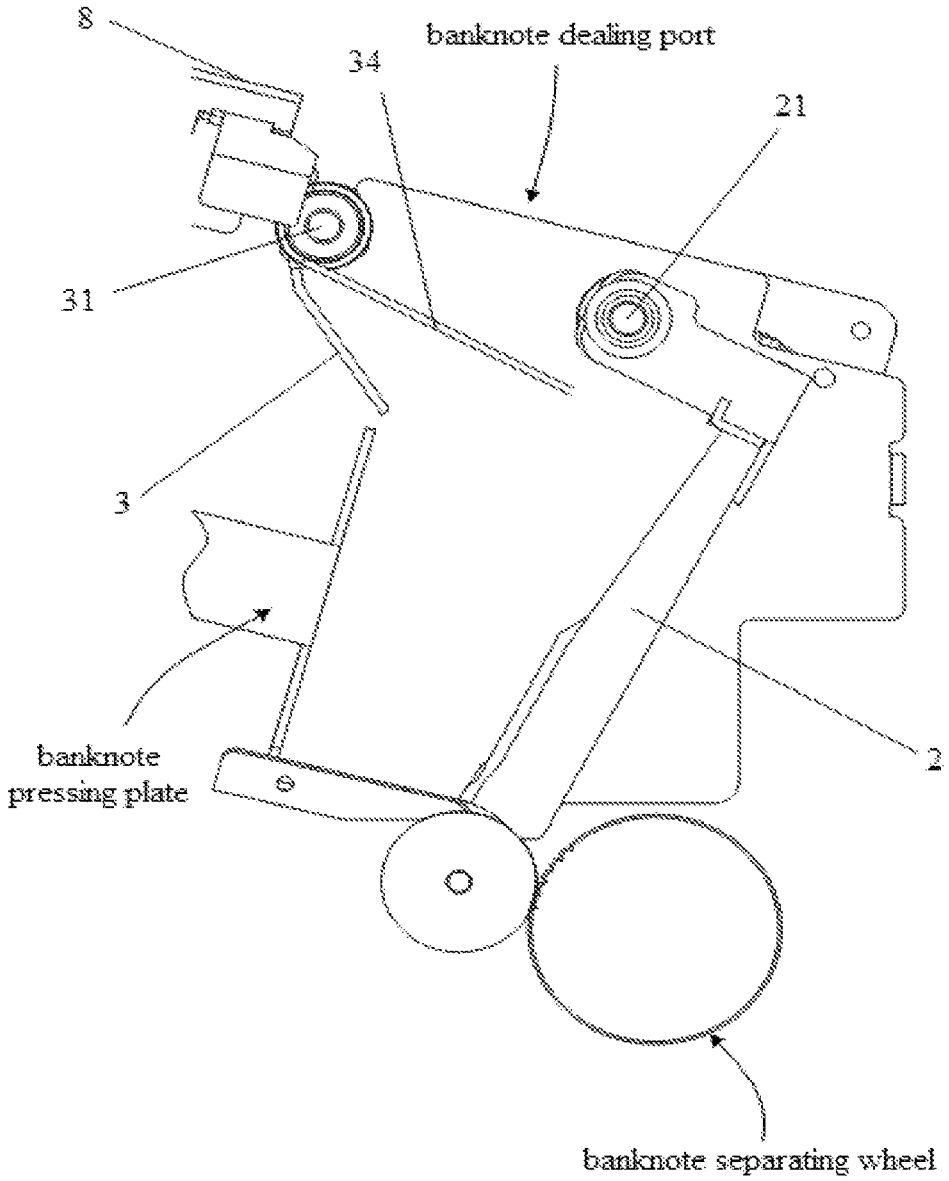
FIG. 8 is a schematic view showing the structure of the linkage device in a state of a shutter of the ATM being opened.

When the linkage device is in the state of the shutter 8 being opened, referring to FIG. 8, the shutter 8 of the ATM is opened, at this time, the output gear 72 is maintained, and the banknote stacking plate 2 is limited by the position-limiting structure 13 and the banknote stacking plate 2 covers the banknote separating mechanisms 4, the cover plate 3 is rotated to cover the impeller wheel type banknote stacking mechanisms 5 at the banknote dealing port. At this time, the foil detector 35 enters the U-shaped sensor, and the torque limiter 23 is in a slipping state.

Figure 9:
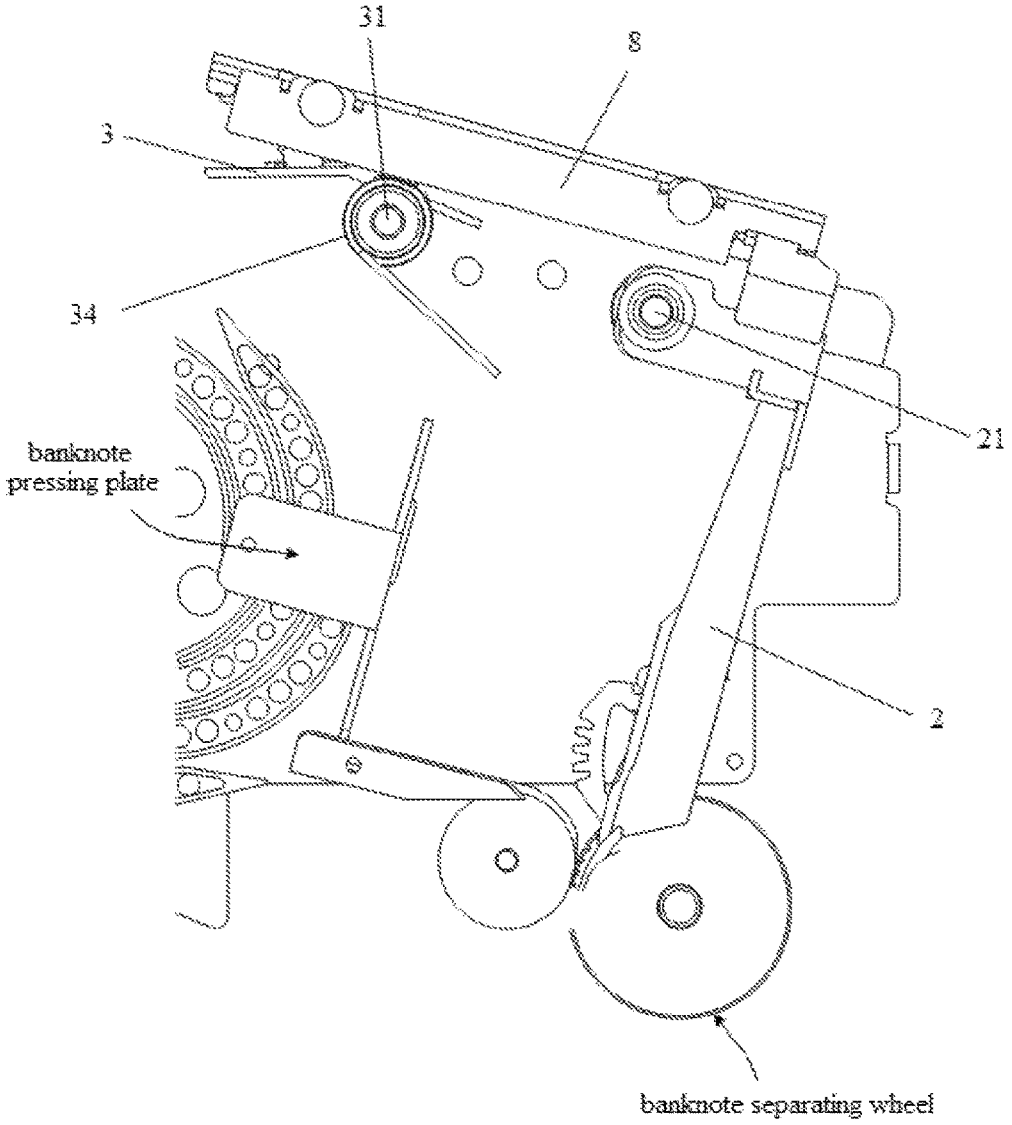
FIG. 9 is a schematic view showing the structure of the linkage device in a state of the shutter of the ATM being closed.

When the linkage device is in the state of the shutter 8 being closed, referring to FIG. 9, the shutter 8 of the ATM is closed, at this time, the motor 71 is de-energized, the banknote stacking plate 2 leaves the position-limiting structure 13 and uncovers a banknote dealing port of the banknote separating mechanism 4, and the cover plate 3 also uncovers the impeller wheel type banknote stacking mechanism 5 at the banknote dealing port, and the foil detector 35 leaves the U-shaped sensor.

The process in which the linkage device is switched from the state of the shutter 8 being opened to the state of the shutter 8 being closed is as follows. The motor 71 works, to allow the output gear 72 to rotate counterclockwise. Since the output gear 72 is engaged with the banknote stacking plate gear 22, the banknote stacking plate gear 22 rotates clockwise, and drives the banknote stacking plate 2 to rotate clockwise. The banknote stacking plate 2 leaves the position-limiting structure 13, and uncovers the banknote dealing port of the banknote separating mechanism 4. Besides, due to the clockwise rotation of the banknote stacking plate gear 22, the cover plate gear 22 is driven by the transmission mechanism to rotate counterclockwise, and the cover plate 3 may not rotate counterclockwise along with the cover plate gear 32 due to the action of the one-way bearing 33. The one-way gear 33 loosens the cover plate shaft 31, thus allowing the cover plate 3 to rotate counterclockwise under the action of a restoring force of the spring 34 to uncover the impeller wheel type banknote stacking mechanism 5. The motor 71 may be de-energized automatically under a time delay control of the ATM after the process finishes.

The process in which the linkage device is switched from the state of the shutter 8 being closed to the state of the shutter 8 being opened is as follows. The motor 71 works, to allow the output gear 72 to rotate clockwise. Since the output gear 72 is engaged with the banknote stacking plate gear 22, the banknote stacking plate gear 22 rotates counterclockwise, and drives the banknote stacking plate 2 to rotate counterclockwise. The banknote stacking plate 2 comes into contact with the position-limiting structure 13, and is limited by the position-limiting structure 13 such that the banknote stacking plate 2 cannot continue to rotate counterclockwise. Under the protection of the torque limiter 23, the banknote stacking plate gear 22 continues to rotate counterclockwise and the banknote stacking plate 2 keeps still. At the same time, since the counterclockwise rotation of the banknote stacking plate gear 22, the cover plate gear 32 is driven by the transmission mechanism to rotate clockwise. Since the one-way bearing 33 may be set to be locked when rotating clockwise, the cover plate 3 may be driven to rotate clockwise when the cover plate gear 32 rotates clockwise. During clockwise rotation of the cover plate 3, the foil detector 35 enters the U-shaped sensor, then the linkage device receives an electrical signal from the U-shaped sensor, the motor 71 is maintained, and the output gear 72 is maintained and does not rotate. At this time, after the cover plate 3 rotates, the cover plate 3 covers the impeller wheel type banknote stacking mechanism 5 at the banknote dealing port, and after the shutter 8 is opened, the motor 71 is de-energized.

In this embodiment, the linkage device may avoid causing issues, such as the banknote separating mechanism 4 and the impeller wheel type banknote stacking mechanism 5 are exposed outside when not needed and are therefore locked by foreign matters placed therein, customers are apt to place the banknotes to a fault position when depositing the banknotes, and the impeller wheel, the banknote separating wheel and other internal structures inside the banknote dealing port are easily damaged due to being exposed externally, thus improving the safety of the internal structures of the ATM, and also allowing the ATM to be friendly to use.

It can be clearly understood by those skilled in the field that, for convenience and concision of the description, the specific operating process of the system, device and unit described above may refer to the corresponding process in the embodiment of the method described above, which will not be described herein again.

In the several embodiments of the present application, it should be appreciated that, the system, the device and the method disclosed herein may be implemented in other manners. For example, the embodiments of the device described above are only schematic. For example, the division of the units is only a division according to logical function, and there may be other division modes in the practical implementation, for instance, multiple units or components may be combined, or may be integrated into another system; and some features may be omitted or may not be performed. In addition, the coupling between the components, direct coupling or communication connection displayed or discussed above may be realized by some interfaces, or indirect coupling or communication connection of devices or units, and may be electrical, mechanical or of other forms.

The above unit described as a separate component may be or may be not physically separate. The component displayed as a unit may be or may be not a physical unit, that is, may be located at one place or may be distributed on multiple network units. The object of the solution of the embodiment may be achieved by selecting a part or all of the units according to the actual requirements.

Furthermore, various function units in the embodiments of the present application may be integrated in one processing unit; or each of the function units may exist in a single physical unit; or two or more function units are integrated in one unit. The above integrated unit may be realized in the form of hardware or in the form of software function unit.

In the case that the integrated unit is implemented in the form of software function unit and is sold or used as a separate product, it can also be stored in a computer readable storage medium. Based on such understanding, the essence, or the part that contributes to the conventional technology of the technical solutions of the present application, or, a part or whole of the technical solutions may be embodied in the form of a software product. The computer software product is stored in a storage medium, and includes several instructions configured to allow a computer device (which may be a personal computer, a server, or a network device, and etc.) to execute all or part of the steps of the method of each embodiment of the present application. The storage medium described above includes various media capable of storing program codes, such as a USB flash disk, a movable hard disk, a Read-Only Memory (ROM), a Random Access Memory (RAM), a magnetic disc or an optical disc.

The above description and the above embodiments are only intended to illustrate the technical solutions of the present application, and should not be interpreted as a limitation to the technical solutions of the present application. Though the present application has been described in detail with reference to the above embodiments, it should be understood by those skilled in the field that, modifications may be made to the technical solutions described in the various embodiments described above, or equivalent substitutions may be made to a part of the technical features in the above embodiments; and all these modifications or substitutions may not make the essence of the respective technical solutions depart from the spirit and scope of the technical solutions of the embodiments of the present application.

The invention claimed is:

1. A linkage device, comprising:

a banknote stacking plate, a cover plate, a transmission mechanism, and a driving mechanism, wherein, a banknote stacking plate transmission is mounted on the banknote stacking plate and configured to drive the banknote stacking plate to rotate;

a cover plate transmission and a spring are mounted on the cover plate, and the cover plate transmission is configured to drive the cover plate to rotate;

a torque limiter is mounted on the banknote stacking plate transmission;

a one-way bearing is mounted on the cover plate transmission;

the transmission mechanism is mounted between the banknote stacking plate transmission and the cover plate transmission, and is configured to provide a medium for a transmission between the banknote stacking plate transmission and the cover plate transmission;

the driving mechanism is configured to provide a rotation power to the banknote stacking plate transmission;

the banknote stacking plate, after rotating by approximately a minimum angle that is required to cover a banknote separating mechanism under the action of a rotation power provided by the driving mechanism, is maintained under the protection of the torque limiter, and the cover plate continues to rotate by approximately a minimum angle that is required to cover an impeller wheel type banknote stacking mechanism under the action of a transmission force provided by the transmission mechanism; and the banknote stacking plate, after reversely rotating by approximately the minimum angle to uncover the banknote separating mechanism under the action of a reverse rotation power provided by the driving mechanism, is maintained under the protection of the torque limiter, and the one-way bearing releases the action on a shaft due to the reverse rotation of the transmission mechanism, and the cover plate reversely rotates by approximately the minimum angle to uncover the impeller wheel type banknote stacking mechanism under the action of the spring.

2. The linkage device according to claim 1, wherein the banknote stacking plate transmission is a banknote stacking plate gear, and the cover plate transmission is a cover plate gear.

3. The linkage device according to claim 2, wherein the driving mechanism comprises: a motor and an output gear; the motor is configured to provide power; and the output gear fits the banknote stacking plate gear by engaging, and is configured to transmit the power outputted by the motor to the banknote stacking plate gear.

4. The linkage device according to claim 3, wherein the transmission mechanism comprises N gears with N being an even number, and the N gears fit each other by engaging engage with each other.

5. The linkage device according to claim 4, wherein the output gear, the banknote stacking plate gear, the N gears and the cover plate gear fit each other by engaging in the listed sequence.

6. The linkage device according to claim 1, further comprising a support frame, wherein, the support frame is configured to support the linkage device;

the support frame comprises a first side plate and a second side plate, the banknote stacking plate is mounted between the first side plate and the second side plate, and the cover plate is mounted between the first side plate and the second side plate; and the driving mechanism, the banknote stacking plate transmission, the transmission mechanism and the cover plate transmission are each mounted on the second side plate.

7. The linkage device according to claim 6, wherein the support frame further comprises a stop block, and the stop block is configured to limit a rotation angle of the banknote stacking plate when the banknote stacking plate rotates by approximately the minimum angle that is required to cover the banknote separating mechanism under the action of the rotation power provided by the driving mechanism.

8. The linkage device according to claim 1, further comprising:

a foil detector mounted on the cover plate and configured to trigger a sensor; and the sensor, which is mounted on the support frame, used cooperatively with the foil detector, and configured to send an electrical signal to the linkage device when the foil detector triggers the sensor.

9. The linkage device according to claim 8, wherein the foil detector triggers the sensor when the cover plate continues to rotate by approximately the minimum angle that is required to cover the impeller wheel type banknote stacking mechanism under the action of the transmission force provided by the transmission mechanism, and the driving mechanism is maintained and does not rotate after the linkage device receives the electrical signal.

10. The linkage device according to claim 9, wherein the sensor is a U-shaped sensor, and one torsion spring is mounted on a cover plate shaft at one end of the cover plate.

* * * * *